US006295700B1

(12) United States Patent
Plzak

(10) Patent No.: US 6,295,700 B1
(45) Date of Patent: Oct. 2, 2001

(54) BUCKLE FOR MAINTAINING TENSION IN A SERPENTINE ARTICLE

(75) Inventor: Stephen J. Plzak, Bryn Mawr, PA (US)

(73) Assignee: Design Research & Development Corporation

( * ) Notice: Subject to any disclaimer, the term of this patent is extended or adjusted under 35 U.S.C. 154(b) by 0 days.

(21) Appl. No.: 09/448,807

(22) Filed: Nov. 24, 1999

Related U.S. Application Data

(63) Continuation-in-part of application No. 09/200,087, filed on Nov. 25, 1998, now abandoned.

(51) Int. Cl.[7] ..... F16G 11/10
(52) U.S. Cl. ..... 24/134 R
(58) Field of Search ..... 24/170, 132 R, 24/133, 134 R, 134 KB, 134 L

(56) References Cited

U.S. PATENT DOCUMENTS

| | | | |
|---|---|---|---|
| 407,592 | * | 7/1889 | Harkness . |
| 921,458 | * | 5/1909 | Raithel et al. . |
| 935,870 | * | 10/1909 | Walter . |
| 1,496,603 | * | 6/1924 | Rothenberger . |
| 1,913,032 | * | 6/1933 | Krause . |
| 2,287,722 | * | 6/1942 | Beazley . |
| 2,442,266 | * | 5/1948 | Davis . |
| 2,471,503 | * | 5/1949 | Ward et al. . |
| 2,845,674 | * | 8/1958 | Pearson . |
| 3,678,542 | * | 7/1972 | Prete, Jr. . |
| 4,148,224 | * | 4/1979 | Craig . |
| 4,424,609 | * | 1/1984 | Boden . |
| 4,425,862 | * | 1/1984 | Hirsch et al. . |
| 4,521,000 | * | 6/1985 | Dodge, Jr. . |
| 4,716,630 | * | 1/1988 | Skyba . |
| 5,408,729 | * | 4/1995 | Schwartz et al. . |
| 5,423,108 | * | 6/1995 | Brennan . |
| 5,577,576 | * | 11/1996 | Petz et al. . |

* cited by examiner

*Primary Examiner*—James R. Brittain
(74) *Attorney, Agent, or Firm*—Dechert

(57) ABSTRACT

A buckle for maintaining tension in a serpentine article includes a main buckle structure having an internal chamber and at least one load bearing portion therein and rotable mounted therein a cam also having at least one load bearing portion. The cam can rotate between first and open positions so that, in the first position, a serpentine article with which the buckle is used is pinched between at least one load bearing portion of the main buckle structure and at least one load bearing portion of the cam; thereby maintaining tensile force or tension in the serpentine article and transmitting same to a structure to which the buckle is coupled at the coupling portion of the main buckle structure.

17 Claims, 12 Drawing Sheets

BUCKLE FOR MAINTAINING TENSION IN A SERPENTINE ARTICLE

The present application is a continuation-in-part of Ser. No. 09/200,087, filed Nov. 25, 1998 now abandoned.

This invention is directed to a tensioning device. More specifically, this application relates to a buckle which can be used to maintain tension in a serpentine article.

There are situations in which there is a need to quickly establish and maintain a tensile force in a serpentine article drawn (e.g. suspended) between two points or attached at one end to an object. In other situations, it is desired to establish and maintain a tensile force between one end of a serpentine article and some other portion of the same serpentine article. Depending on the particular end-use, it may be desired to maintain the force indefinitely or it may be desired to release the force at some time.

Buckles should function under a wide variety of end-use situations in which they will be exposed to extremes of environmental conditions; for example dry, sub-zero, arctic-like conditions, or wet, tropical, marine conditions. The buckles may also be subject to mechanical abuse and, because they perform very basic functions, their maintenance is easily overlooked. Thus, the invention provides buckles of robust design.

Buckles for maintaining tension in serpentine articles have application in diverse situations. For example, in the marine market they are useful for handling and securing dock lines, tow lines, and on straps for flotation devices. On sailboats they are useful as components of rigging, including on down hauls and preventers and for securing sails, furled or unfurled, to the boom, the deck, or to themselves.

In markets for sporting or recreational goods, buckles find use in combination with straps for tents, backpacks (including straps to secure items to the backpack), fanny packs, sleeping bags, and climbing harnesses and with ropes for climbing lines. Snowshoes, ski boots, hiking boots, and skates can be snugly secured to the foot with the aid of buckles.

In transportation, buckles can be used to tension hold downs for roof racks, ski racks, bicycle racks, and canoes. Buckles can be advantageously used in belt-like products for securing loads in or on a trailer, securing batteries and battery covers, lashing-down motorcycles or lashing equipment to motorcycles, securing convertible soft-tops, securing boats to trailers (e.g. so-called belly bands).

In medical markets, buckles can be used as components in traction devices (for treating muscular-skeletal injuries), in abdominal and thoracic binders, in sphygmomanometer cuffs, in retaining or securing orthopedic devices (including splints and casts), and as components of a tourniquet assembly.

Buckles are also used in goods for the home. For example, buckles are useful for holding Christmas trees in Christmas tree stands as described in copending U.S. patent application Ser. No. 08/676,714 which is incorporated herein by reference in its entirety.

There is a plethora of uses to which buckles can be put. Applicant has developed a robust buckle which can be used widely.

SUMMARY OF THE INVENTION

A buckle for maintaining tension in a serpentine article includes a static main buckle structure having a coupling portion and an interior chamber, which can be a through aperture, and a rotatable cam, hinged or rotably coupled to the main buckle structure within the interior chamber of the latter. The cam has end surfaces and an operating surface. The interior surface of the chamber defines at least one load bearing portion, denoted a main buckle structure load bearing portion. The operating surface of the cam also defines at least one load bearing portion, denoted a cam load bearing portion.

The cam is cylindrically, prolate, or irregularly shaped and in use it can rotate about an axis of rotation relative to the main buckle structure between closed and open positions. In the closed position, at least one load bearing portion of the cam is so juxtaposed to at least one load bearing portion of the main buckle structure that a serpentine article adapted to pass between the load bearing portions of the main buckle structure and the cam is pinched between at least one load bearing portion of the main buckle structure and at least one load bearing portion of the cam. In this way, a serpentine article is pinched between load bearing portions of the cam and main buckle structure and is securely arrested by and in the buckle and a tensile force or tension in a so adapted serpentine article is imparted to the coupling portion of the main buckle structure. Conversely, in the open position, load bearing portions of the main buckle structure and load bearing portions of the cam are so juxtaposed that a serpentine article adapted to pass through the buckle between the load bearing portions of the main buckle structure member and the load bearing portions of the cam can slip through the buckle. Preferably, the at least one cam load bearing portion remains in the interior of the buckle when in the closed or open position, or when rotated between the two positions.

The cam can be provided with a handle portion which can be used to rotate the cam away from the closed position by applying a force to the handle portion. The handle portion can be a cantilever arm having a channel through which a serpentine article, with which the buckle is used, can pass. The cam can also be provided with an elongated groove of variable cross sectional area, which runs from a point distal to at least one load bearing portion of the cam to a point proximal to a load bearing portion of the cam.

The interior chamber of the main buckle structure can also be provided with curvilinear guide surfaces to assist in threading a serpentine article through the buckle.

The buckle can be coupled at the coupling portion of the main buckle structure to another structure, such as a buckle hinge or main buckle support arrangement or structure, or to an end of a serpentine article, using suitable means.

A buckle of the invention can be combined with, for example, a serpentine article adapted to pass between the cam and main buckle structure to make a device suitable for coupling, holding, or teathering an object to a main buckle support arrangement, or for holding one object alone or a bundle of two or more objects by creating a tensile force in the serpentine article which tensile force acts in a direction substantially parallel to the free exterior surface or surfaces of the object or objects to be held. The free exterior surface of an object is a surface, or portion thereof, that is not in contact with the exterior surface, or portion thereof, of another object. If the object being held has a circular cross section, the tensile force in the serpentine article is a hoop stress.

BRIEF DESCRIPTION OF THE DRAWINGS

FIGS. 9A and 9B show perspective views.

FIG. 9C shows, in cross-section, the buckle in open position.

FIG. 9D shows, in cross-section, the buckle in closed position.

DETAILED DESCRIPTION OF THE INVENTION

Figure 1:
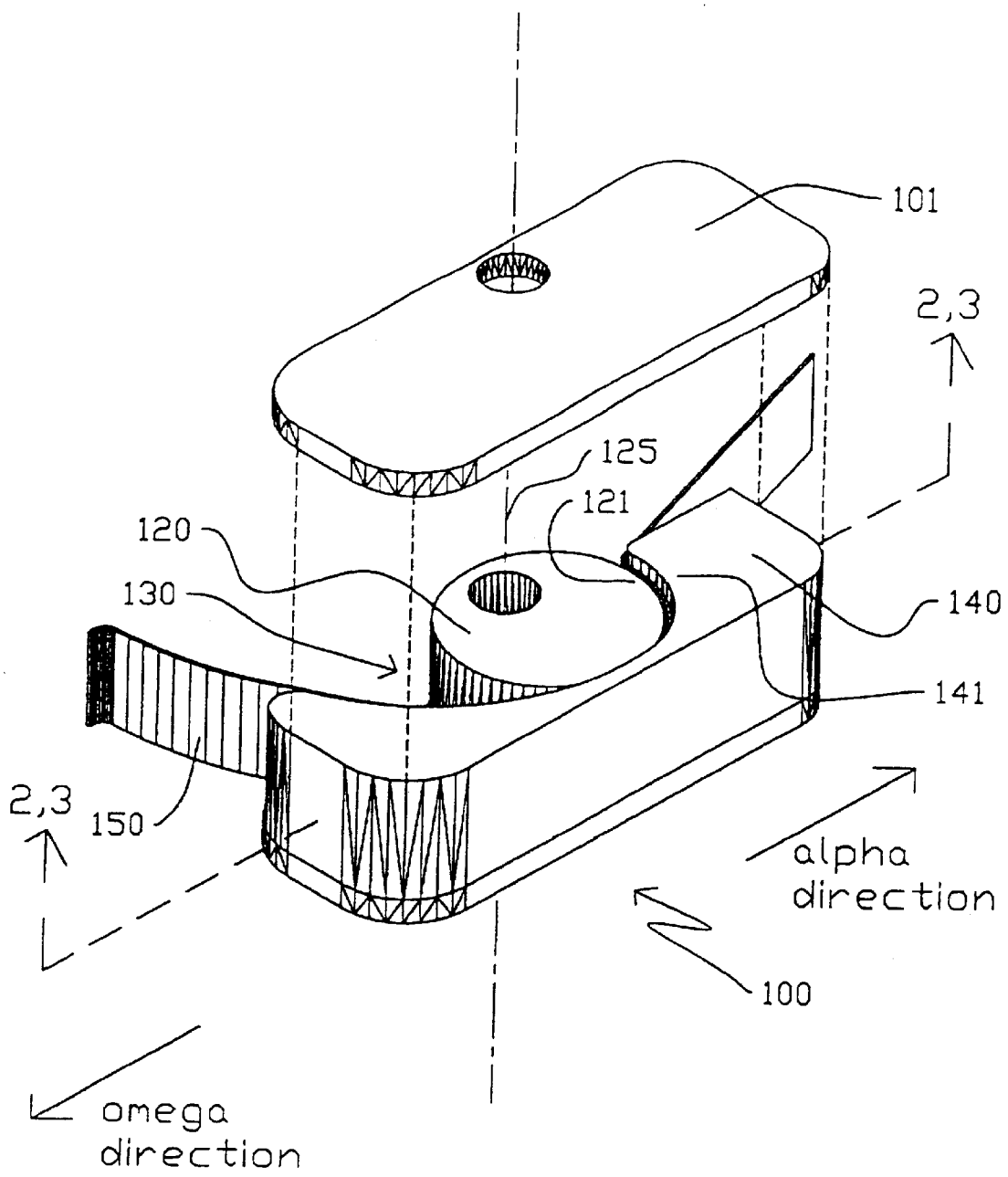
FIG. 1 is an isometric view of a buckle of the invention in which the rotating member, or cam, has a circular cross section.

Buckles of the invention are tensioning devices that fix, maintain, or impart a tensile force in a serpentine article. The term serpentine article is used herein to denote articles having an aspect ratio (i.e. largest dimension divided by the mean dimension perpendicular to the largest dimension) of at least about 3. That is, the length of such articles is greater than the mean dimension of their cross sections. Some examples of serpentine articles include: ropes, cables, chains, wire, roving, yam, thread, twine, string, tow, monofilament, straps (for example an elongated flexible strap), ribbons, belting and belts, and cords. This list is illustrative only and many more examples of serpentine articles with which the buckles of the invention are useful will be obvious to one skilled in the art.

The invention may be embodied in any of a number of buckles. All embodiments share certain features. Each embodiment includes a static member, which is the main buckle structure, having an internal chamber (which can be a through aperture), and a rotating member, also denoted as the cam arrangement or simple the cam, rotably coupled by a suitable means, for example a binge coupler, to the main buckle structure within the internal chamber of the main buckle structure for rotation about an axis of rotation relative to the main buckle structure. The main buckle structure can have practically any shape. For example, it can be elongated or it can have essentially equal dimensions in all directions or it can be cylindrical. The cam has two end surfaces and an operating surface. The main buckle structure and the cam each have at least one region or portion, which can be elongated, that is identified as a load bearing portion. The load bearing portions of the main buckle structure are on the surface of the internal chamber of the main buckle structure. The load bearing portions of the cam are on the operating surface of the cam. The main buckle structure and the cam are so sized, juxtaposed, and coupled that a serpentine article suitable for use with the buckle will, when threaded through the buckle, pass between the main buckle structure and the cam in such a manner that a tensile force on the serpentine article acting in one direction, arbitrarily designated the alpha direction, forces the serpentine article to contact the cam (in those embodiments where the serpentine article is not already in contact therewith) and causes the cam to rotate about its axis of rotation so that the serpentine article becomes pinched between at least one load bearing portion of the cam and at least one corresponding load bearing portion of the main buckle structure. Such a tensile force in the alpha direction can arise, for example, as a force in reaction to a tensioning force applied to the serpentine article in a direction opposite to the alpha direction; which direction is arbitrarily denoted the omega direction.

Conversely, when an unopposed tensile force is applied to the serpentine article in the omega direction, the cam rotates so that all load bearing portions of the cam move away from corresponding load bearing portions of the main buckle structure; thereby allowing the serpentine article to slip through the buckle without being pinched.

The Figures diagramatically depict features of the buckles of the invention necessary to understanding and practicing the invention. Many other embodiments of the invention will be apparent to the skilled artesian and such are considered to be within the scope of the invention as defined by the claims.

FIG. 1 shows buckle 100, embodying the invention, in isometric view. To aid understanding, buckle 100 is shown with side plate 101 separated. In FIG. 1, cam 120 has a cylindrical shape and is located in internal cavity 130 of main buckle structure 140. Cam 120 has a first cam load bearing portion 121 and main buckle structure 140 has a first main buckle structure load bearing portion 141. Main buckle structure can have side plate 101 or main buckle structure 140 can be a single piece without a side plate. Cam 120 rotates about cam axis of rotation 125 in response to a tensile force in either the alpha or omega direction imposed on serpentine article 150, with which buckle 100 can be used. Axis of rotation 125 does not necessarily pass through the geometric center of cam 120.

Figure 2:
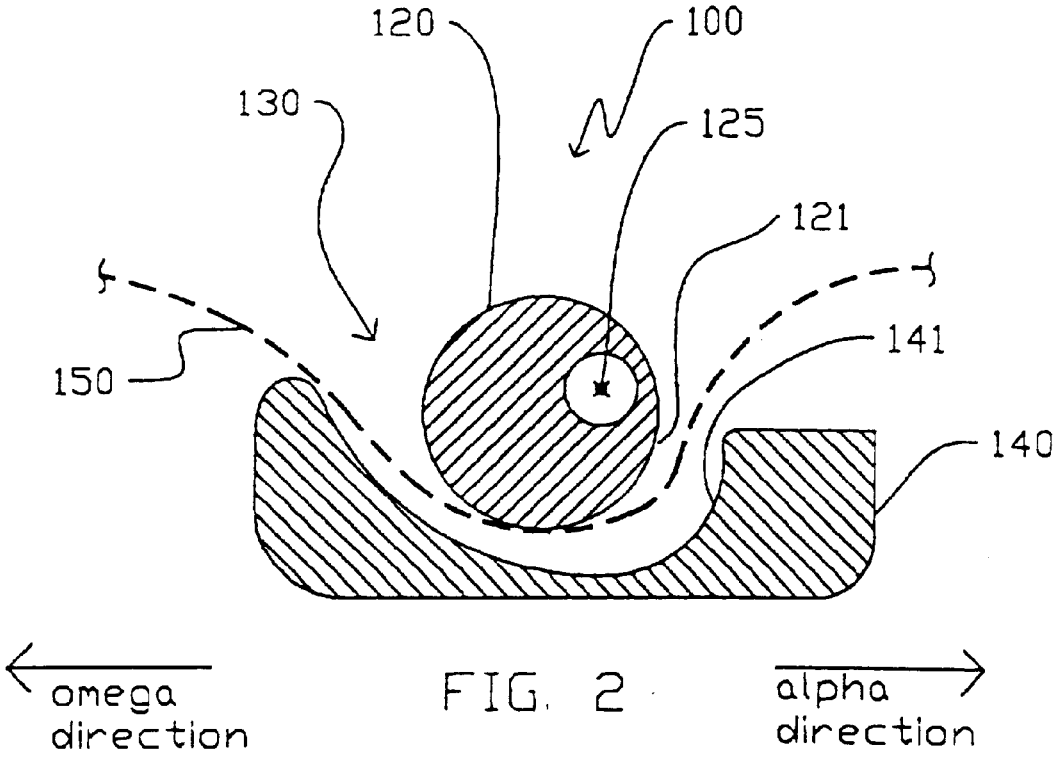
FIGS. 2 and 3 are cross sectional views of the buckle of FIG. 1 showing the cam in the open and closed positions, respectively.
Figure 3:
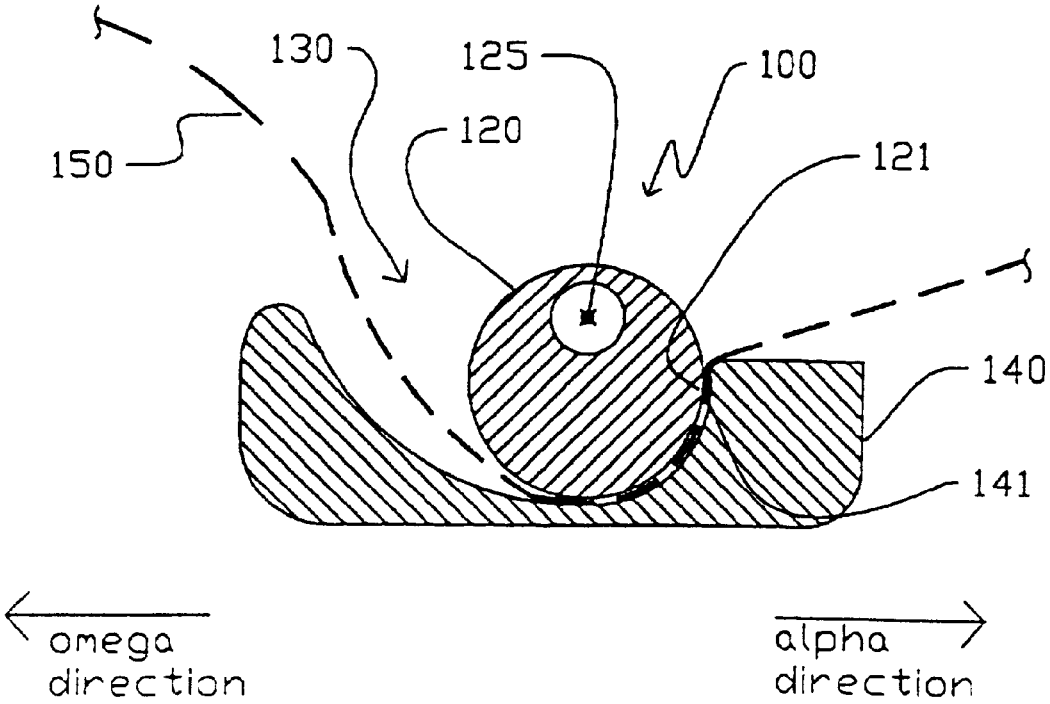

FIGS. 2 and 3 are schematic cross sectional views of buckle 100. Cam 120 is rotably mounted to main buckle structure 140 in interior chamber 130 defined within the body of main buckle structure 140. Cam 120 is coupled to the main buckle structure 140 so that it rotates about axis of rotation 125, which is perpendicular to the plane of the view of FIGS. 2 and 3.

Cam 120 has at least a first cam load bearing portion 121. The surface of interior chamber 130 of main buckle structure 140 also defines at least a first main buckle structure load bearing portion 141. In one state of rotation, arbitrarily denoted the open state, the load bearing portions of main buckle structure 140 and cam 120 are spaced apart from each other so that a serpentine article with which the buckle is suitable for use can slip through the buckle. Cam 120 is depicted in the open state in FIG. 2.

In another position or state of rotation, which can be induced, for example, by a tensile force acting in the alpha direction as discussed above, cam 120 is positioned so that at least first cam load bearing portion 121 bears against or, in other embodiments, passes in extremely close proximity to, corresponding first main buckle structure load bearing portion 141. "Extremely close proximity" is a relative term and is understood in relation to the serpentine article with which the buckle is to be used. Load bearing portions are in extremely close proximity when they are separated, at at least one point, by a distance less than the smallest dimension of the cross section of serpentine article 150 with which buckle 100 is used. As noted above, this position or state of rotation in which the respective load bearing surfaces of the cam and the main buckle structure bear on each other or are in extremely close proximity to each other is arbitrarily referred to as the closed position. Cam 120 is shown in the closed position in FIG. 3. To aid understanding, serpentine article 150 with which buckle 1 can be used is also depicted in FIG. 3. It will be apparent that, in the closed position, a serpentine article with which the buckle is used is pinched between load bearing portions of the cam and main buckle structure and is thereby securely arrested within the buckle.

In use, cam 120 can be rotated between closed and open positions. In the closed position, as discussed above, at least the first cam load bearing portion 121 and first main buckle structure load bearing portion 141 bear against each other or are in extremely close proximity to each other. In the open position, load bearing portions of cam 120 and main buckle structure 140 are so juxtaposed that serpentine article 150 with which buckle 1 can be used can slip between cam 120 and main buckle structure 140 and through buckle 100. When cam 120 is in the open position, a force in the alpha direction (indicated by arrow in FIGS. 1–3) acting on serpentine article 150 threaded through buckle 100 causes cam 120 to rotate in the direction of the closed position, thereby arresting serpentine article 150 in the buckle. A force on serpentine article 150 in a direction opposite to the alpha direction (i.e. in the omega direction) causes cam 120 to rotate towards the open position, releasing serpentine article 150 and allowing it to slip between cam 120 and main buckle structure 140.

In this or any other embodiment, the surface of the cam preferably has a texture that does not so impede slippage of a serpentine article through the buckle when the cam is in the open position that the buckle is difficult to use and does not operate smoothly. Generally, the cam will have a smooth surface, but this is not necessary. In certain embodiments, the surface of the cam is provided with ciliations, protuberances, or serrations, being from a fraction of a millimeter to several millimeters in length. These may be orthogonal to the surface of the cam or, preferably, they are disposed at an angle to the surface of the cam such that, in the closed position, the angle between the surface of the load bearing portion of the cam and the protuberance, ciliation, or serration is greater than 90°, when measured in a direction opposite to the alpha direction.

FIGS. 1 through 3 depict an embodiment in which cam 120 has a circular cross section (i.e., the cam is cylinder shaped) when viewed parallel to axis of rotation 125 (such as a point along an extension of the axis of rotation). This is not a necessary limitation. In other embodiments, the cross section of the cam is a truncated circle (e.g. half-moon shaped). In yet other embodiments, the cam is advantageously prolate or "egg" shaped when viewed parallel to the axis about which it rotates. In such embodiments, at least one load bearing portion of the cam is located at or adjacent to an apex of the prolate-shaped cam. It will be apparent that the size, shape, and location of the load bearing portions of the main buckle structure will vary with the size and shape of the cam, as well as with the position of the coupling of the cam to the main buckle structure.

The shape of the load bearing portion of the main buckle structure is chosen to complement that of the cam. For example, in FIGS. 2 and 3 cam 120 has a circular cross section and main buckle structure load bearing portion 141 of main buckle structure 140 has a concave semicircular shape having a radius of curvature that is similar to that of the operating surface of the cam. In other embodiments, when the cam is prolate shaped, the surface of the interior chamber of the main buckle structure has at least one protuberance, extending in the direction of the cam, and so juxtaposed that the protuberance presents at least one surface portion against which the load bearing portion of the cam can bear, or come in extremely close proximity to, when the cam is rotated to the closed position.

Figure 4:
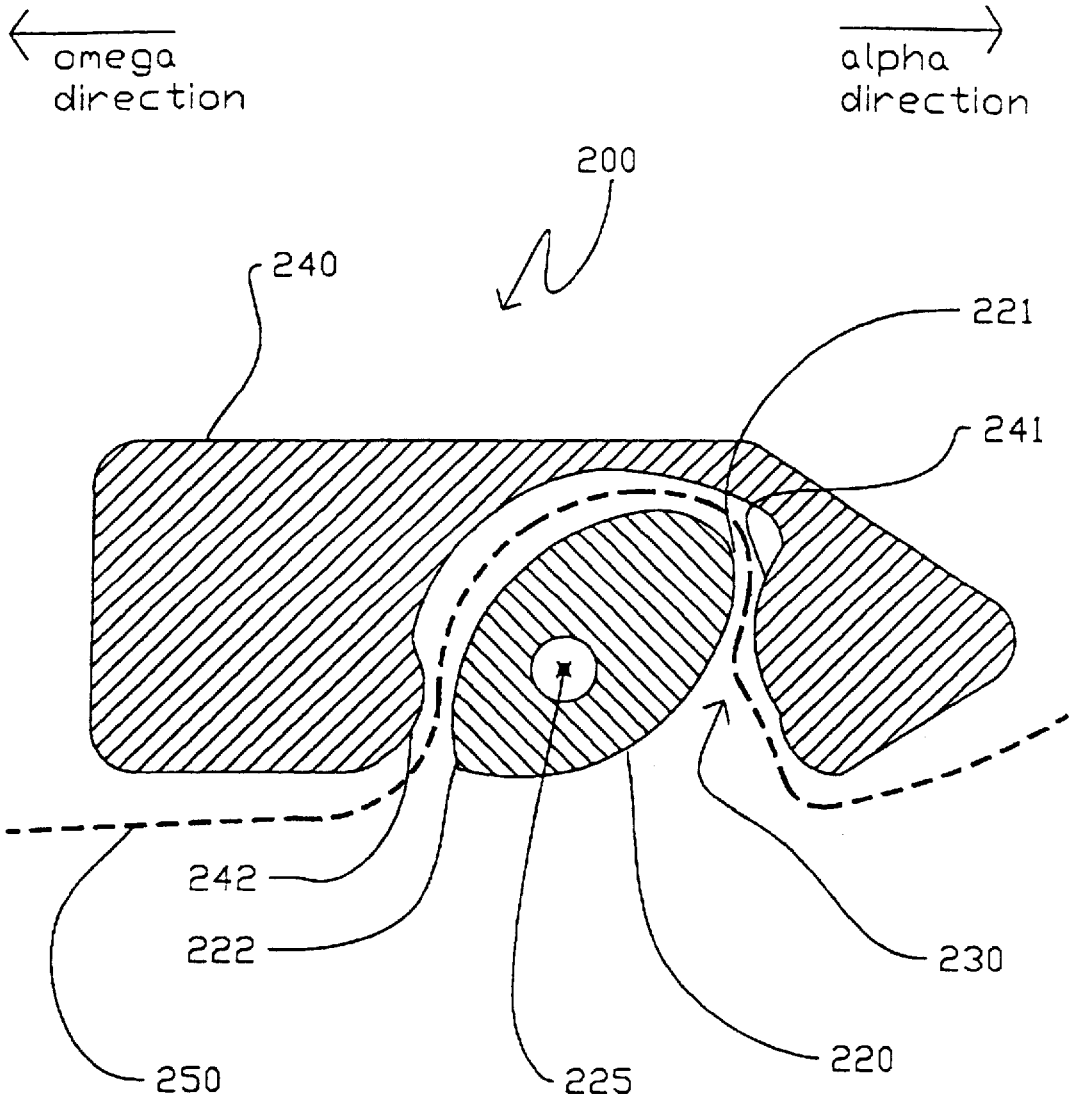
FIG. 4 is a cross sectional view of a buckle according to the invention, taken perpendicular to the axis about which the cam rotates, in which the cam has an unsymmetrical prolate shape.

Yet another embodiment of the buckle of the invention, 200, is depicted schematically in FIG. 4. Cam 220 is prolate shaped and is provided with first and second cam load bearing portions 221 and 222. Main buckle structure 240 is likewise provided with first and second main buckle structure load bearing portions, 241 and 242. A cross section of serpentine article 250 with which the buckle can be used is shown in FIG. 4. In this and similar embodiments, cam 220 is rotably mounted in the interior chamber 230 of main buckle structure 240 at a point between main buckle structure load bearing portions 241 and 242 and rotates relative to the main buckle structure about axis of rotation 225. Preferably, although by no means necessarily, cam 220 is prolate shaped. The radius of curvature of the operating surface of the cam at each apex of the prolate shape can be the same or different.

Axis of rotation 225 can pass through the center of mass of cam 220, or it can pass through another part of cam 220. The center of mass of cam 220 is the point about which all gravitational forces acting on the cam are exactly in balance and the cam has no tendency to rotate under the influence of gravity alone.

In the embodiment depicted in FIG. 4, the cam rotates about axis of rotation 225 between closed and open positions. In the open position, first cam load bearing portion 221 and second cam load bearing portion 222 are spaced apart from the corresponding first and second main buckle structure load bearing portions 241 and 242. and serpentine article 250 can slip through buckle 200, between the respective load bearing portions of the main buckle structure and the cam. A tensile force in the alpha direction (indicated by an arrow in FIG. 4) in serpentine article 250 passing through the buckle and between the load bearing portions of the main buckle structure and the cam causes the cam to rotate to the closed position in which first cam load bearing portion 221 bears on or is in extremely close proximity to first main buckle structure load bearing portion 241 and second cam load bearing portion 222 bears on or is in extremely close proximity to second main buckle structure load bearing portion 242. In the closed position, a serpentine article is securely pinched between the respective load bearing portions of cam 220 and main buckle structure 240 so that once a serpentine article is drawn through the buckle and a tensile force is generated in the serpentine article in the alpha direction, the serpentine article will be securely arrested by the buckle and, absent stress relaxation, this tensile force will be held essentially indefinitely.

Figure 5:
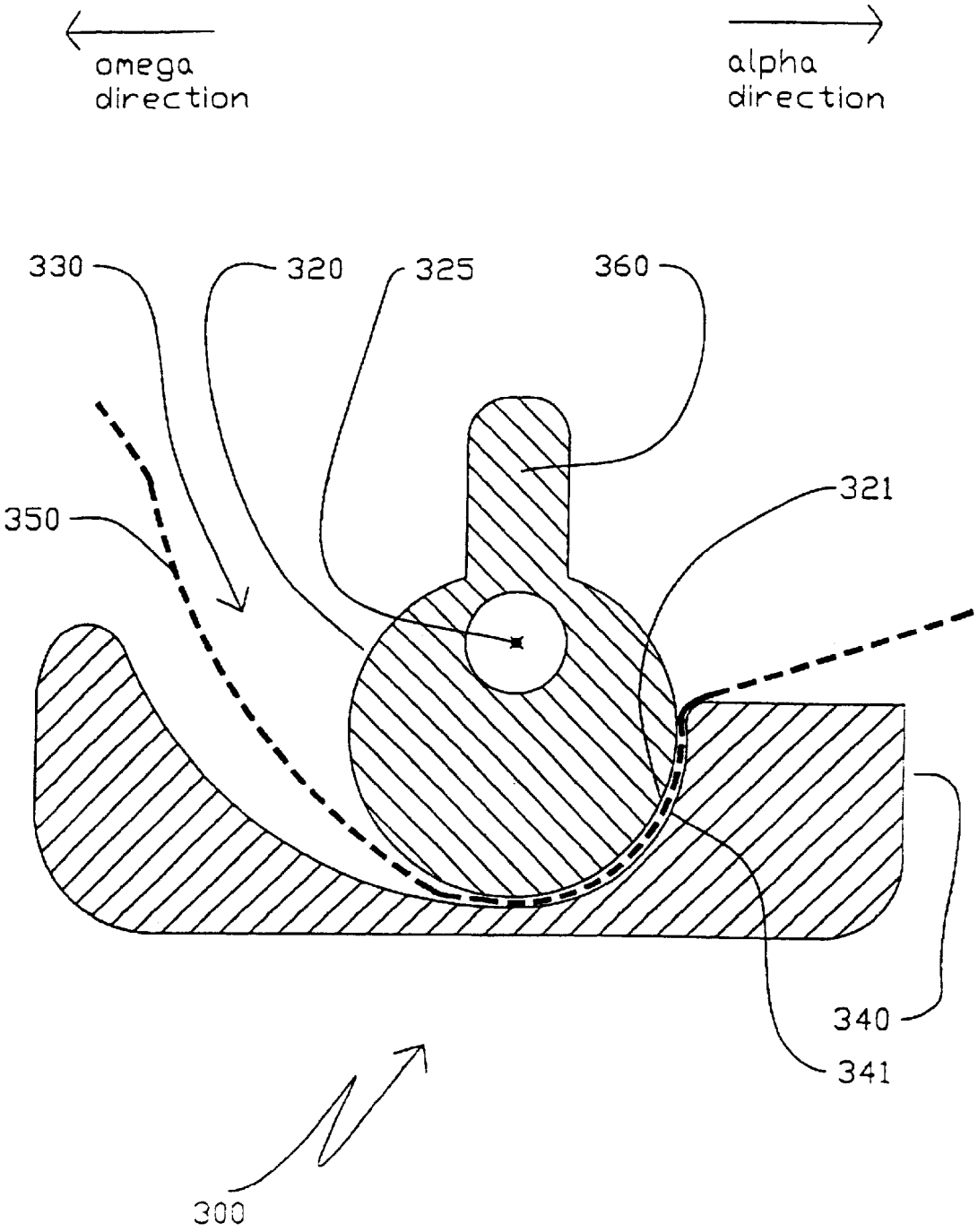
FIG. 5 is a cross sectional view of a buckle of the invention showing a handle portion that is a cantilever arm.

In some applications it is desirable to be able to decrease or even completely release a tensile force that is being maintained in a serpentine article that is pinched between load bearing portions of a cam and main buckle structure of a buckle of the invention. FIG. 5 shows a cross section taken through the middle of buckle 300, perpendicular to axis of rotation 325 of cam 320. In this and other embodiments of the invention, cam 320, rotably coupled to main buckle structure 340, is provided with handle portion 360, which is a cantilevered arm. Application of a force in the alpha direction to handle portion 360 causes cam 320 to rotate within interior cavity 330 so that cam load bearing portion 321 moves away from main buckle structure load bearing portion 341, allowing serpentine article 350 arrested in the buckle, to slip in the alpha direction. The location of handle portion 360 on cam 320 is not critical as long as it is accessible to the user and does not block passage of a serpentine article through the buckle.

Figure 6:
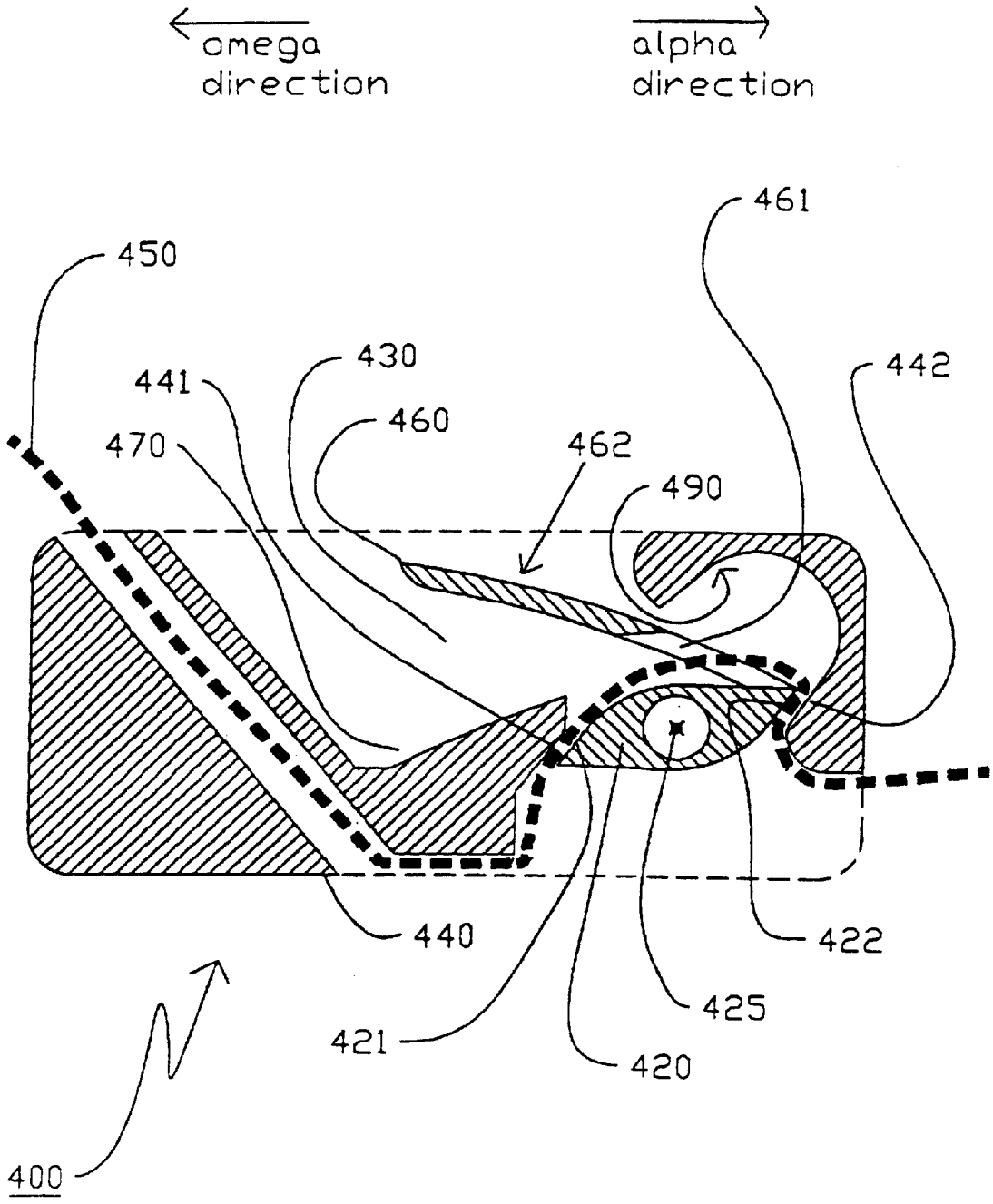
FIG. 6 is a cross sectional view of a buckle according to the invention in which the cam and main buckle structure each have two load bearing portions, the cam has a slotted cantilever arm, and the main buckle structure has a guide surface and a stopping surface.

In yet another embodiment, a cross section of which is given FIG. 6, buckle 400 has cam 420 with first and second cam load bearing portions 421 and 422. Main buckle structure 440 is provided with complementing first and second main buckle structure load bearing portions 441 and 442. Cam 420 is located in interior chamber 430 and is provided with handle portion 460 that is a cantilever arm having channel 461 at a point near the point at which anterior surface 462 of handle portion 460 meets and melds with the operating surface of cam 420. The shape, size, and location of the channel are not critical as long as serpentine article 450 can pass unrestricted through the channel. In some embodiments) the shape and size of channel 461 are similar to the cross section of the serpentine article with which the buckle is to be used. It is preferred but not necessary that channel 461 be located proximal rather than distal to the point at which anterior surface 462 of the cantilever arm meets and melds with the surface of the cam. However, the exact position of channel 461 is not critical.

By reference to FIG. 6, application of a force to anterior surface 462 handle portion 460 at a point distal to the point of attachment of handle portion 460 to cam 420 will cause cam 420 to rotate towards the open position (i.e. in the counterclockwise direction as viewed in the plane of FIG. 6), thus allowing serpentine article 450 to slip in the alpha direction.

A stopping surface 470 can also be provided. This stopping surface limits the rotation of the cam in the direction of the open position.

Figure 7:
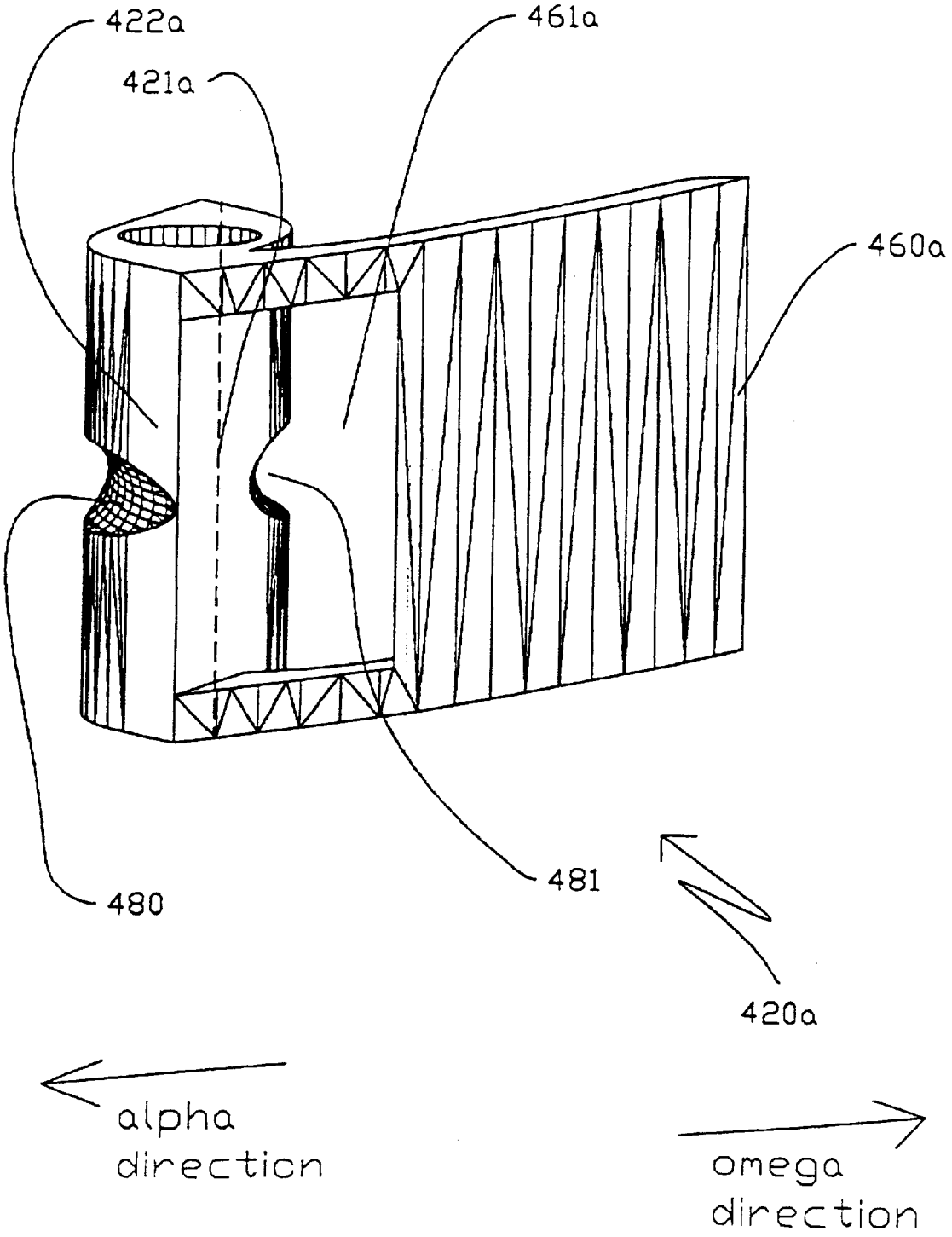
FIG. 7 depicts a cam according to the invention in which the cam has two load bearing portions and is provided with grooves having variable cross section.

FIG. 7 is an isolated view of cam 420*a*, which is a particular embodiment of cam 420, showing handle portion 460*a* having channel 461*a* and optional grooves 480 and 481 that have variable cross sections. The cam is advantageously provided with such grooves in certain embodiments, especially but not exclusively where the cam has two cam load bearing portions and is provided with a slotted cantilever arm as shown in FIG. 7. Providing one or more grooves on a cam of the invention allows the same buckle to be used with serpentine articles having cross sections of differing shape; for example rectangular, circular, semicircular, and elliptical, to mention just a few, or with serpentine articles of different cross-sectional dimensions but having the same cross-sectional shape. The cross sections of grooves 480 and 481 are not everywhere uniform. Rather, the cross sectional area of each groove is a maximum at a point, the location of which is not critical, away from a load bearing portion (e.g. 422*a* or 421*a*) of cam 420*a*. The cross sectional area of each such a groove decreases along the long dimension of the respective groove in a direction extending from the point at which the cross sectional area of the groove is a maximum toward each load bearing portion, 421*a* and 422*a*, of cam 420*a*. The cross sectional area of each such groove vanishes at the load bearing portions or at a point proximal to the load bearing portions of cam 420*a*. In preferred embodiments, the distance between the load bearing portion and the point where the cross section of the groove vanishes is not more than about 5 times the mean cross section of the smallest serpentine article with which the buckle is to be used. The grooves can be merged at the point where their respective cross sections are a maximum.

As discussed above, a force in the alpha direction in a serpentine article adapted for use with which a buckle of the invention causes the cam to rotate to the closed position. In certain embodiments, buckles of the invention may be provided with one or more cam closing members which predispose the cam to rotate towards the closed position, whether or not a force in the alpha direction is imparted to a so-adapted serpentine article.

In those embodiments in which the cam is provided with a handle portion and a stopping surface, the cam closing member can be, for example, a coil or leaf spring interposed between and coupled to the handle portion and the stopping surface such that a force opposing compression of the spring predisposes the cam to rotate towards the closed position. Alternatively, in such embodiments a cam closing member may be a coil spring or a section comprising an elastomer (e.g. a rubber or thermoplastic elastomer) interposed between the handle portion and any other portion of the buckle and coupled to such other portion of the buckle so that rotation of the cam towards the open position causes extension of the spring or section comprising an elastomer and concomitant generation of a force opposing rotation of the cam towards the open position and biasing the cam towards the closed position.

In yet other embodiments in which the cam is fitted with a handle portion, the cam closing member can be a cantilever spring, one end of which contacts the handle portion and the other end of which is coupled to the main buckle structure.

In still other embodiments in which the cam rotates about an axle, the cam closing member can be a coil spring having two ends and mounted within the cam so that the long axis of the spring is coincident with the axis about which the cam rotates. The coil spring may be without or within the axle. In such embodiments, one end of the coil spring is coupled to the main buckle structure and the other end of the coil spring is coupled to the cam, either directly or via the axle, in such a manner that rotation of the cam towards the open position causes the coil spring to open (or close), thereby creating a force biasing the cam towards the closed position.

The cam closing member can also comprise magnetic material or material attracted by a magnetic field. For example, complementing load bearing portions of the cam and main buckle structure can each comprise magnets so aligned that, when the cam is in the closed position, opposite poles of the respective magnets face each other, thereby generating a magnetic force biasing the cam to the closed position. Alternatively, one or more of the load bearing portions of either the cam or the main buckle structure can comprise a magnet; the load bearing portions of that structure that does not comprise a magnet comprising a material attracted by a magnetic field. Materials attracted by a magnetic field include but are not limited to ferromagnetic materials. Other suitable materials will be obvious to the skilled artesian.

It will be apparent that, in those embodiments in which the cam has two load bearing portions, as does cam 420*a*, the groove extends in the direction of both such load bearing portions and the cross section of the groove vanishes at points proximal to each of the load bearing portions of the cam. Although here exemplified for cam 420*a* of buckle 400, any embodiment of a cam of the invention can be advantageously provided with a groove of variable cross section of the type discussed above.

Referring to FIG. 6, in those embodiments in which cam 420 is provided with slotted handle portion 460, the surface of the interior chamber of the main buckle structure can define at least one guide surface 490. Guide surface 490 is a curvilinear surface shaped to assist threading a serpentine article through the buckle, between the load bearing portions of main buckle structure 440 and cam 420. The curvilinear surface is concave when viewed from the operating surface of cam 420. In one embodiment, the guide surface begins at and is contiguous with a load bearing portion of the main buckle structure; emanating at a line parallel to the axis of rotation 425 of the cam at a load bearing portion of the main buckle structure. Guide surface 490 then extends in curved fashion to and terminates at another line, located on the surface of interior chamber 430 of the main buckle structure 440, parallel to axis of rotation 425 and near the channel opening in slotted handle portion 460. The guide surface is so shaped that the guide surface in the vicinity of handle portion 460 is approximately parallel to the center line of channel 461 in slotted handle portion 460. Approximately parallel means that a line drawn tangent to curvilinear surface 490 in the plane of FIG. 6 from line at which curvilinear surface 490 terminates and in the direction of cam 420 will pass through channel 461 without intersecting the walls of channel 461. In this way, a serpentine article conforming to the shape of the guide surface will be positioned to easily pass into slot 461 when cam 420 is in the open position. A similar guide surface can be provided at the other load bearing portion of the cam. Buckles of the invention can be provided with other guide surfaces, the positioning of which will be obvious to one skilled in the art. The guide surface is adapted so that an end of a serpentine article (e.g., serpentine article 450) inserted between second cam load bearing portion 421 and second main buckle structure load bearing portion 442 is directed into the channel, facilitating the task of threading the serpentine article into the buckle.

In general, the details of the cam hinge coupler or other means by which the cam is rotably coupled to the main buckle structure are not critical as long as the cam can rotate between the closed and open positions. By way of example, the buckle can be provided with a hinge coupler that is an axle that passes through the cam in a direction perpendicular to the end surfaces of the cam. The axle can optionally be provided with a bearing. Such an axle can be secured in the buckle by any conventional means. Where an end of the axle is threaded, the axle can be provided with a nut and one or more washers at that end. Alternatively, the axle can be provided with a cotter pin or pins or be peened. In yet other embodiments, the main buckle structure can be provided with detents having a rounded shape for engaging depressions or cavities in the end surfaces of the cam. Yet another alternative is to provide a protrusion (e.g. hinge pin) on end surfaces of the cam, which protrusions fit into holes, depressions, or slots in the main buckle structure, thereby providing rotable coupling between cam and main buckle structure. Many other embodiments for the hinge coupler to rotably couple the cam to the main buckle structure will be apparent to the skilled artesian and these are considered within the scope of the invention.

In use, the buckles of the invention can be coupled to a buckle support structure by means of a buckle hinge or support arrangement. A tensile force imparted to a serpentine article, for example by pulling, is transmitted via the coupling portion of the main buckle structure to the buckle support structure. The location of this coupling portion is not critical as long as it is so located that a tensile force imparted to a serpentine article with which the buckle is used is imparted to and opposed at the coupling portion. When the main buckle structure is coupled to a buckle support structure at the coupling portion, the coupling portion is preferably but not necessarily located along a line that is parallel to the direction of the applied tensile stress and that passes through the center of the cam. The skilled artesian will recognize that the exact location of the coupling portion can be varied depending on the particular end-use.

Figure 8A:
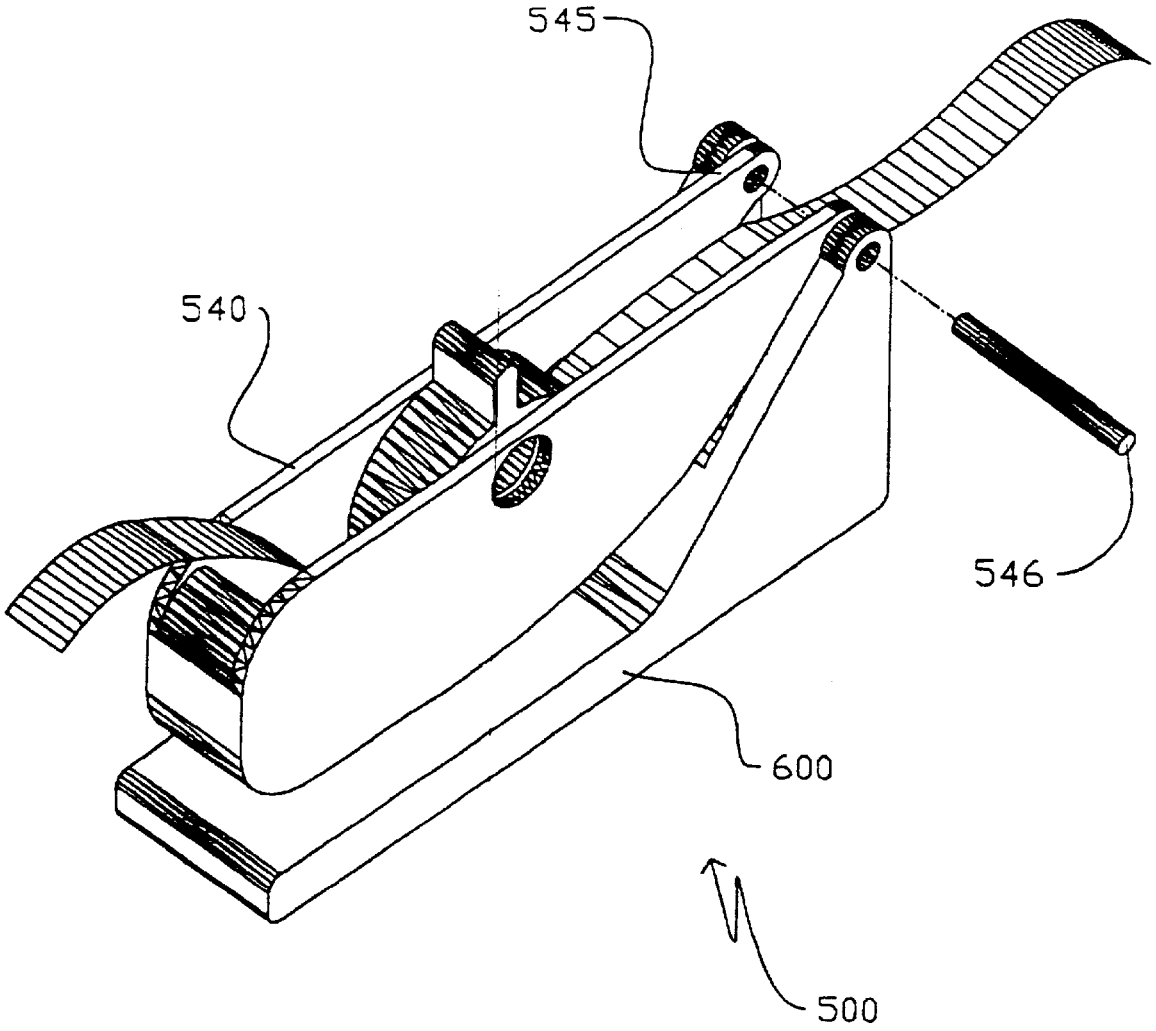
FIGS. 8A and 8B depict but two of the vast number of possible constructions for the coupling portion of the main buckle structure.

The physical structure and design of the buckle at the coupling portion of the main buckle structure can take many forms. Mechanical coupling, fixing, or mounting of the buckle to the support structure is by a buckle hinge or support arrangement and can be fixed, hinged, or partly or fully rotable. The skilled artesian will recognize that the construction of the coupling portion will be varied to suit the particular application. By way of example, as shown in FIG. 8A, the coupling portion 545 of the main buckle structure 540 can be a buckle hinge or support arrangement so that the main buckle structure is hingeably coupled to buckle support structure 600, to which a tensile force in the serpentine article is to be imparted, by means of pin 546. Generally, the longest dimension of pin 546 will be parallel to the axis of rotation of the cam. The particular design of the buckle at the coupling portion as embodied in buckle 500 shown in FIG. 8A is but one of a multitude of embodiments that will be apparent to one skilled in the art and such are considered to be within the scope of the invention.

FIG. 9A through FIG. 9D illustrate a preferred buckle 700. Buckle 700 has side plates 701 and 702. Pin 726 fits along axis of rotation 725 through side plates 701 and 702 to engage cam 720 through pin-engaging channel 727. Cam 720 is attached to arm 763. A threading device is formed of threading plate 770A and curved threading plate 770B. The threading device is formed in two pieces to facilitate molding of the buckle. As illustrated, pins 771 fit into slots 772 to fix the threading plate 770A to the remainder of buckle 700. Preferably, the fit between pins 771 and slots 772 is tight enough to render the initial fit essentially permanent. The threading plate, with or without use of pins, can be fixed by adhesive, sonic welding, or the like. In spring-engaging slot 773 a spring-engaging pin is formed (not shown) to engage spring 774, which serves as a cam closer, biasing the cam in the closed position. The cam 720 has first cam load bearing portion 721 and second cam load bearing portion 722.

The threading plate provides a self-threading function. Serpentine article 750 is threaded from "below," meaning into entry slot 781 and through slot 782. The serpentine article 750 is then threaded down channel 761. When the end of serpentine article 750 meets the space between first cam load bearing portion 721 and first buckle structure load bearing portion 741, it either passes between the two if the cam is in the open position, or pushes the two load bearing portions apart, to move the cam into open position. The end of serpentine article 750 then meets the threading plate, which is shaped to direct the serpentine article through the buckle and upwards to exit slot 783. In this way, threading the serpentine article is conducted from an accessible entry slot and an accessible channel, and the further internal threading operations are self-threading.

Buckles of the invention are, in certain preferred embodiments, self-tightening, meaning that a force along the serpentine article in the alpha direction pushes the cam so that the opposing load bearing portions are more fully engaged. With this feature, the need for a cam closer is attenuated.

Buckles of the invention can be any size. The size of the buckles of the invention are limited only by practical considerations such as the manufacturing techniques at the disposal of the skilled artesian.

Buckles of the invention can be fabricated of any convenient material. Wood, metal, ceramic, thermoplastic resin, and thermosetting resin, to mention a few, are all suitable materials of construction.

Buckles of the invention can be used, for example, to hold or teather an object to a buckle support structure by means of a serpentine article having first and second ends. The first end of the serpentine article can be coupled to the object to be held or teathered by a means suitable to the particular object. The second end of the so-coupled serpentine article can be passed through the main buckle structure so that the serpentine article passes between at least one load bearing portion of the cam and at least one load bearing portion of the main buckle structure.

Figure 8B:
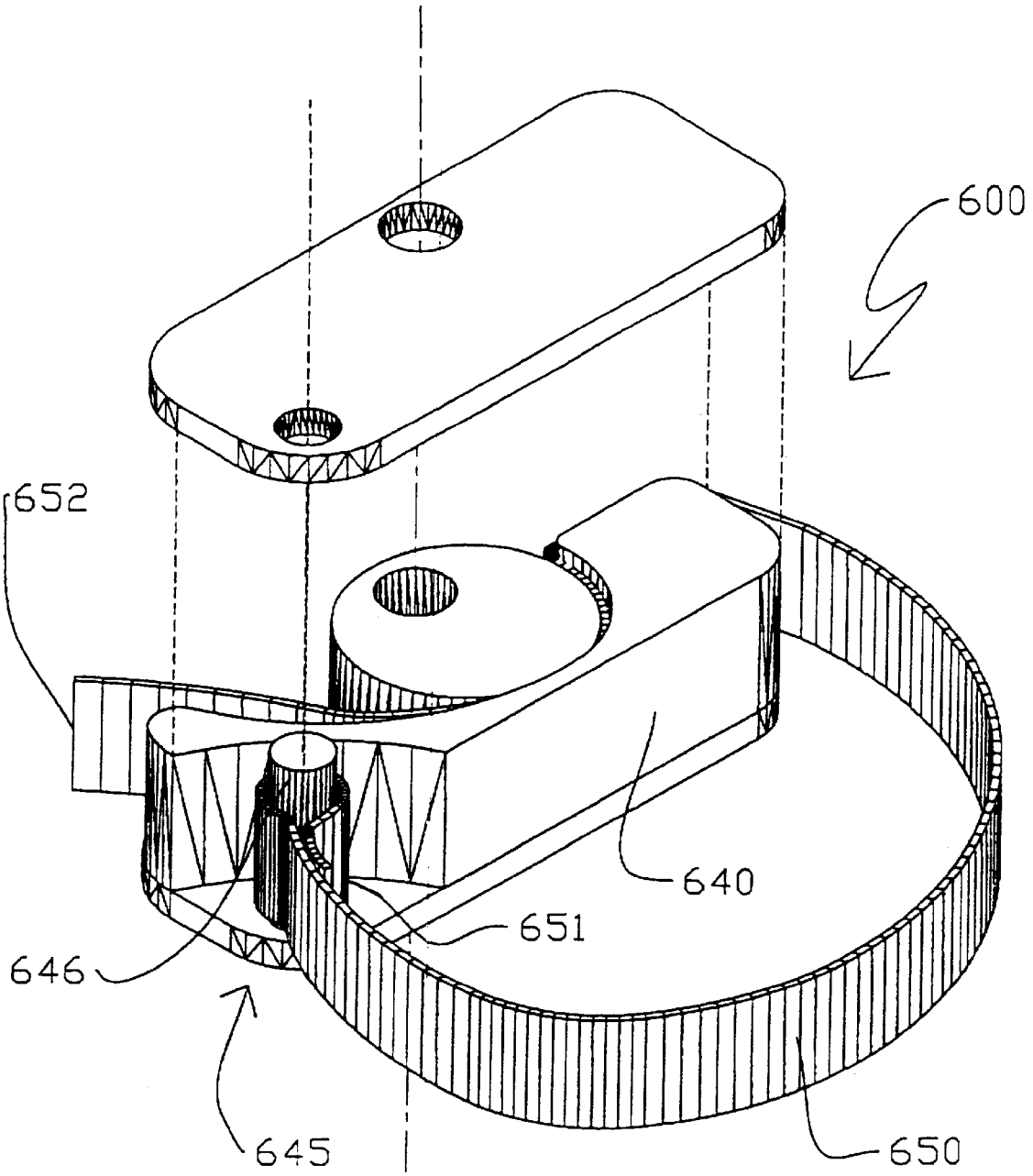
Figure 9A:
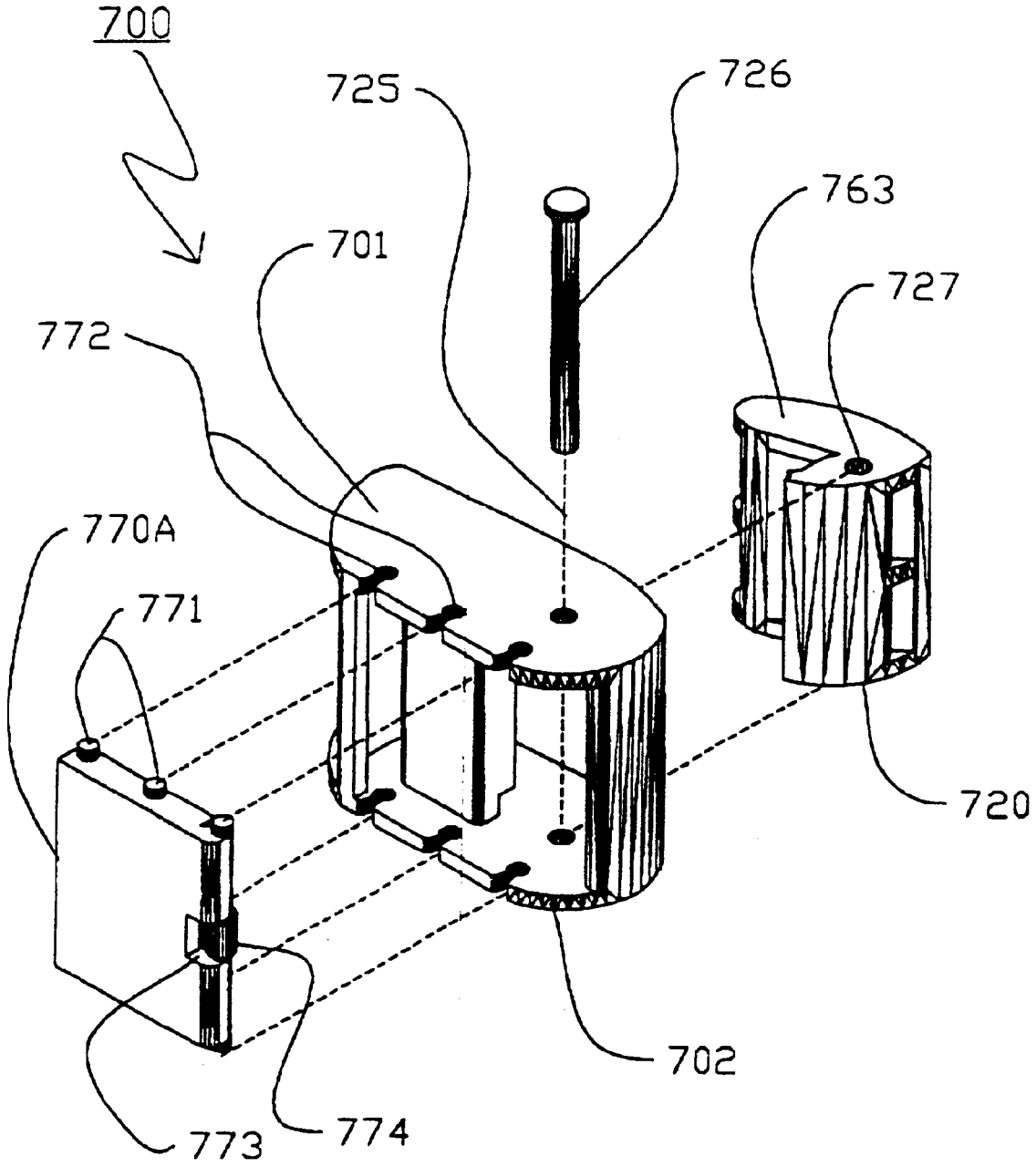
FIGS. 9A through 9D illustrate another buckle of the invention.
Figure 9B:
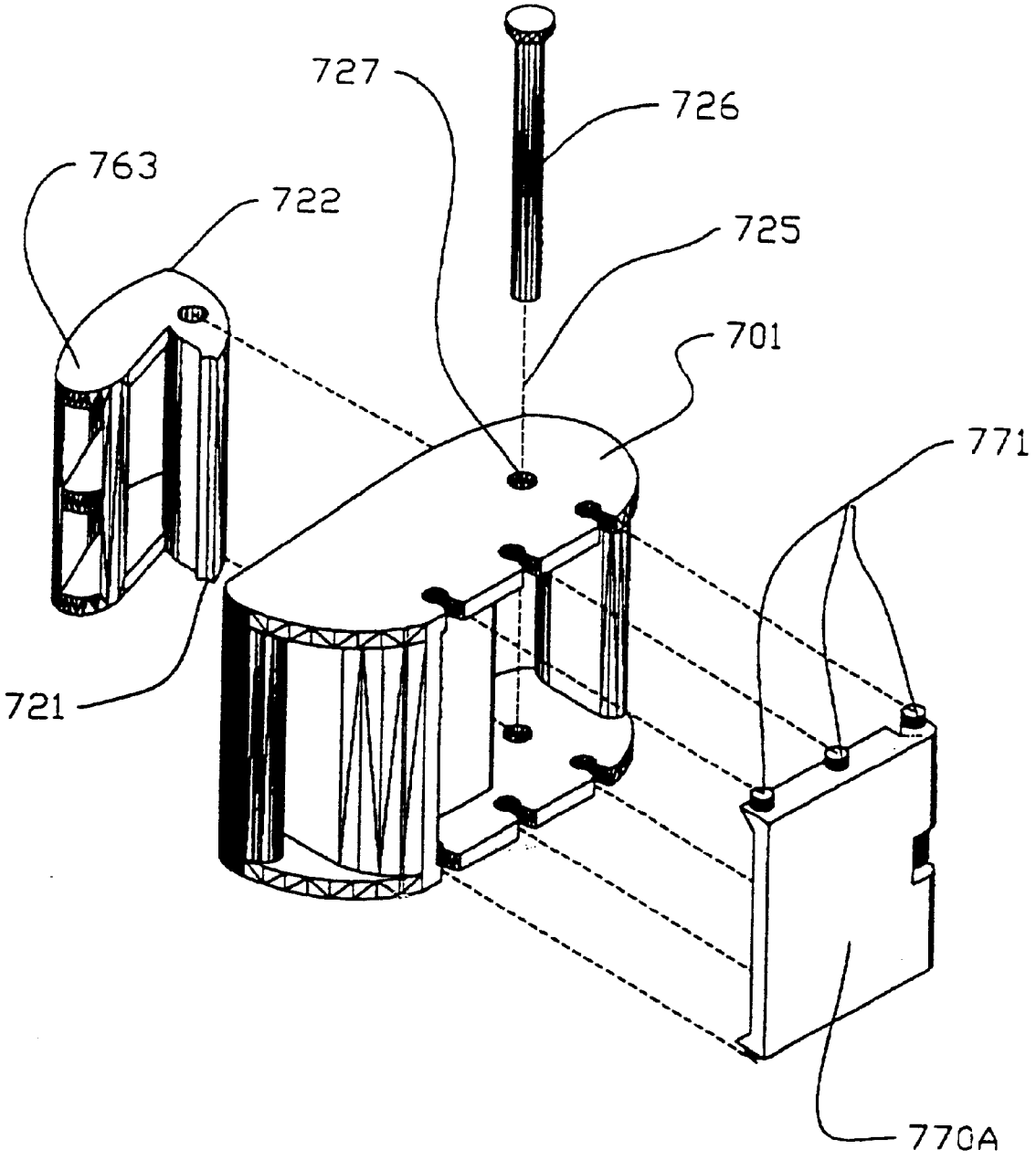
Figure 9C:
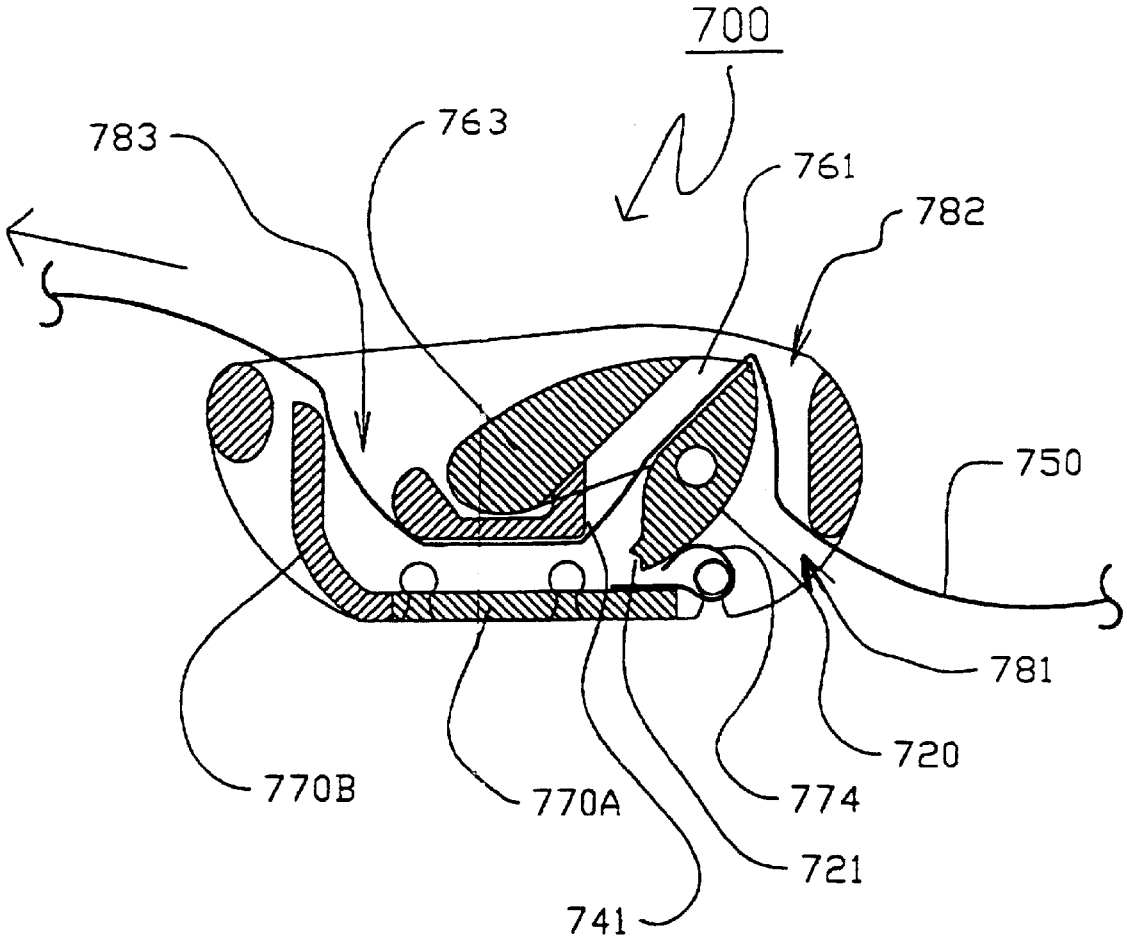
Figure 9D:
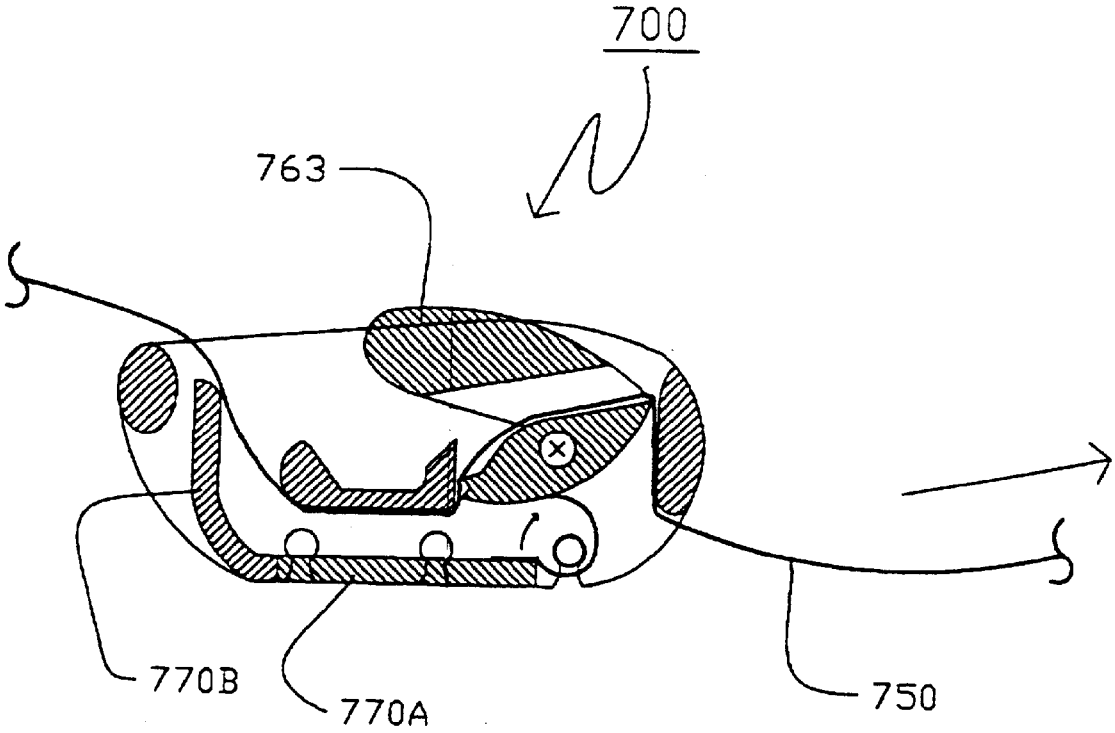

In other embodiments, such as that depicted in FIG. 8B, first end 651 of a serpentine article 650 having first and second ends 651 and 652 can be coupled to main buckle structure 640 at the coupling portion 645 of the main buckle structure to form a device for holding one or more objects. In such embodiments, the coupling of serpentine article 650 to the main buckle structure can be effected by any suitable means or method. For example, the coupling portion can be a post or pin 646, as depicted on buckle 600 in FIG. 8B, and serpentine article 650 can be draped over the post and secured back to itself, by any suitable means, to from a loop. Alternatively, the coupling portion can take the form of an orifice, for example a slot, through which the serpentine article passes; the end of the serpentine article being secured back to itself by any suitable conventional means to form a loop. For example, if the serpentine article is a flat flexible elongated strap, the end of the serpentine article can be passed through such a slot and secured back to the serpentine article by a suitable means, for example sewing, gluing, or riveting, so as to form a loop. A variety of clamps or fastening devices well known to those skilled in the art can also be used to secure the serpentine article to itself Alternatively, the device for holding one or more objects can be formed by attaching the serpentine article directly to the main buckle structure at the coupling portion of the main buckle structure by suitable means such as gluing, stapling, screwing, or riveting, to mention just a few possibilities. Many other means and designs for mechanically fixing or coupling the serpentine article to the buckle will be obvious to the skilled artesian and these are considered to be within the scope of the invention.

A method for using the device for holding one or more objects, as described in the preceding paragraph, can comprise the following steps: i) passing the second end of the serpentine article through the main buckle structure of the device so that the serpentine article passes between at least one load bearing portion of the cam and at least one load bearing portion of the main buckle structure, ii) circumposing the serpentine article about the one or more objects to be held, and iii), applying a tensile force to the serpentine article, wherein the tensile force in the serpentine article constricts the one or more objects to be held.

All publications and references, including but not limited to patents and patent applications, cited in this specification are herein incorporated by reference in their entirety as if each individual publication or reference were specifically and individually indicated to be incorporated by reference herein as being fully set forth. Any patent application to which this application claims priority is also incorporated by reference herein in its entirety in the manner described above for publications and references.

For clarity and conciseness, the invention has been described in the Figures and foregoing discussion in terms of particular embodiments. This discussion and diagrammatic depiction of particular representative embodiments is not intended to and should not be construed as limiting the scope of the invention. Many other embodiments and variations will be obvious to the skilled artesian and these variations and embodiments are considered to be within the scope of the invention as claimed.

I claim:

1. A buckle for maintaining tension in a serpentine article with a main structure and a cam, the buckle comprising:

(a) the main structure comprising a coupling portion and an interior chamber, the surface of which interior chamber defines a curvilinear guide surface, which curvilinear guide surface comprises at least one first load bearing portion, which first load bearing portion is located within the interior chamber, wherein the curvilinear surface is adapted to guide the serpentine article (1) from an insertion point adapted to receive the serpentine article from a tension-bearing direction, (2) between the cam and the first load bearing portions, (3) through the interior chamber, and (4) out at an exit point leading to a release direction, and (b) the cam rotably coupled to the main structure comprising at least one second load bearing portion, wherein the cam rotates about an axis of rotation between closed and open positions such that, when the cam is in the closed position, at least one second load bearing portion of the cam is so juxtaposed to a corresponding first load bearing portion that a serpentine article passing between the cam and the first load bearing portions is pinched between the first load bearing portions and the corresponding second load bearing portions;

wherein a tensile force on the serpentine article in the tension-bearing direction acts to further rotate the cam to increase the pinching force on the serpentine article;

wherein a tensile force on the serpentine article in the release direction acts to further counterrotate the cam to release the pinching force on the serpentine article; and wherein a tensile force in the tension-bearing direction is adapted to apply a force vector substantially orthogonal to a said first load bearing portion located proximal to the insertion point.

2. The buckle of claim 1 wherein the cam has a circular cross section when viewed parallel to the axis of rotation about which it rotates, which axis of rotation does not pass through the geometric center of the cam having a circular cross section.

3. The buckle of claim 1 wherein the cam has an unsymmetrical prolate-shaped cross section when viewed parallel to the axis of rotation of the cam.

4. The buckle of claim 3 wherein the radius of curvature at one apex of the prolate-shaped cross section is greater that the radius of curvature at the other apex of the prolate-shaped cross section.

5. The buckle of claim 4 further comprising an arm coupled to the cam, wherein the arm further comprises a channel through the arm and located proximal to the operating surface of the cam, wherein the channel is of dimensions such that a serpentine article adapted to be pinched between load bearing portions of both the main structure and the cam can pass through the channel.

6. The buckle of claim 5 further comprising, as a portion of the main structure, at least one curvilinear surface, being concave when viewed from the axis about which the cam rotates, wherein the at least one curvilinear surface emanates along a line adjacent to a load bearing portion of the main structure and extends to a terminal line, such that, when the buckle is in the open position, an imaginary line that is tangent to the curvilinear surface at a single point on the curvilinear surface proximate to the terminal line so that the curvilinear surface is effective to direct an end of the serpentine article to thread through the channel.

7. The buckle of claim 5, further comprising a third load bearing portion of the main structure and a fourth load bearing portion or the cam, wherein the buckle is adapted to have an end of the serpentine article threaded (1) from an insertion point adapted to receive the serpentine article from a tension-bearing direction, (2a) between the first and second load bearing portions, (3a) through the channel, (3b) between the third and fourth load bearing portions and (4) out at an exit point leading to a release direction.

8. The buckle of claim 7 further comprising a cam closer that applies a force to the cam favoring the closed position.

9. The buckle of claim 8 wherein the cam closer comprises a spring positioned to apply a force biasing the cam to the closed position.

10. A device for holding one or more objects comprising:

(a) a main structure comprising a coupling portion and an interior chamber, the surface of which interior chamber defines a curvilinear guide surface, which curvilinear guide surface comprises at least one first load bearing portion, which first load bearing portion is located within the interior chamber, wherein the curvilinear surface is adapted to guide the serpentine article (1) from an insertion point adapted to receive the serpentine article from a tension-bearing direction, (2) between the cam and the first load bearing portions, (3) through the interior chamber, and (4) out at an exit point leading to a release direction, (b) a cam rotably coupled to the main structure and having an operating surface comprising at least one second load bearing portion, and (c) a serpentine article having first and second ends and adapted to pass between the first and second load bearing portions, wherein the cam rotates about an axis of rotation between closed and open positions such that, when the cam is in the closed position, at least one second load bearing portion of the cam is so juxtaposed to a corresponding first load bearing portion that the serpentine article passing between the cam and the first load bearing portions is pinched between the first load bearing portions and the corresponding second load bearing portions;

wherein a tensile force on the serpentine article in the tension-bearing direction acts to further rotate the cam to increase the pinching force on the serpentine article;

wherein a tensile force on the serpentine article in the release direction acts to further counterrotate the cam to release the pinching force on the serpentine article; and wherein a tensile force in the tension-bearing direction is adapted to apply a force vector substantially orthogonal a said first load bearing portion located proximal to the insertion point.

11. A buckle, having a top and bottom, for maintaining tension in a serpentine article comprising:

(a) a main structure comprising a coupling portion and an interior chamber, the surface of which interior chamber defines first and second load bearing portions, the main structure having an insertion point proximal to the second load bearing portion adapted to receive the serpentine article from a tension-bearing direction, (b) located within the interior chamber, a cam, rotably coupled to the main structure at a position between the first and second load bearing portions of the main structure, having end surfaces and an operating surface on which are defined third and fourth load bearing portions, wherein the cam rotates between closed and open positions such that, in the closed position, the third load bearing portion is so juxtaposed to the first load bearing portion and the fourth load bearing portion is so juxtaposed to the second load bearing portion that a serpentine article can pass between the main structure and the cam be pinched between the cam load bearing portions and the load bearing portions; and wherein in the open position the third and fourth load bearing portions and the first and second load bearing portions are so juxtaposed that the serpentine article can slip between the main structure and the cam, c) an arm, attached to the cam, and being so shaped that a force applied to an anterior surface of the arm in a direction perpendicular to the axis about which the cam rotates opposes rotation of the cam towards the closed position, and d) a channel through the arm, wherein the channel is of dimensions such that a serpentine article adapted to be arrested between the load bearing portions of the rotating and main structures can pass through the channel, and e) a threading surface, wherein the buckle is adapted to have the serpentine article (1) thread from the insertion point upwards between the second and fourth load bearing portions, then (2) thread downwards through the channel and between the first and third load bearing portions, and (3) be directed by the threading surface back towards the top of the buckle to an exit point leading to a release direction, wherein the threading surface is positioned below an outlet from between the first and third load bearing portions and curved so that the serpentine article is directed by the threading surface back towards the top of the buckle.

12. The buckle of claim 11, wherein the main structure comprises a coupling portion to which one end of the serpentine article is fixed, wherein the buckle is adapted to accept another end of the serpentine article at the insertion point for threading step (1).

13. The buckle of claim 11, wherein a tensile force on the serpentine article in the tension-bearing direction acts to further rotate the cam to increase the pinching force on the serpentine article; and a tensile force on the serpentine article in the release direction acts to further counterrotate the cam to release the pinching force on the serpentine article.

14. The buckle of claim 11, wherein a tensile force in the tension-bearing direction is adapted to apply a force vector substantially orthogonal to the second load bearing portion located proximal to the insertion point.

15. The buckle of claim 11, further comprising, on the operating surface of the cam, at least one elongated groove of variable cross sectional area whereby the cross sectional area of the groove is greatest at a point between the third and fourth load bearing portions and decreases in both directions along a line traversing the operating surface of the cam between the third and fourth load bearing portions so that the cross sectional area of the channel vanishes at points immediately antecedent to the third and fourth load bearing portions.

16. The buckle of claim 11 further comprising;

i) a cantilevered arm having anterior and posterior surfaces attached to the cam and being so shaped that a force applied to the anterior surface of the cantilivered arm in a direction perpendicular to the axis about which the cam rotates opposes rotation of the cam towards the closed position, and ii) on the cantilever arm, a channel through the cantilever arm located proximal to the fourth load bearing portion of the cam from which the anterior surface of cantilevered arm emanates wherein the channel is of dimensions such that a serpentine article adapted to be arrested between the load bearing portions of the cam and main buckle structure can pass through the channel.

17. The buckle of claim 11 wherein at least one of the first through fourth load bearing portions is serrated.

* * * * *